US008763219B2

(12) United States Patent
Jonsson et al.

(10) Patent No.: US 8,763,219 B2
(45) Date of Patent: Jul. 1, 2014

(54) METHOD OF PRODUCING A HYDROENTANGLED NONWOVEN MATERIAL

(75) Inventors: Agneta Jonsson, Landvetter (SE); Arie Venema, ND Suameer (NL); Gaatze Wijbenga, ND .Suameer (NL); Mikael Standqvist, Lindome (SE)

(73) Assignee: SCA Hygiene Products AB, Göteborg (SE)

( * ) Notice: Subject to any disclaimer, the term of this patent is extended or adjusted under 35 U.S.C. 154(b) by 0 days.

(21) Appl. No.: 14/113,919

(22) PCT Filed: May 3, 2012

(86) PCT No.: PCT/SE2012/050461

§ 371 (c)(1),
(2), (4) Date: Dec. 12, 2013

(87) PCT Pub. No.: WO2012/150902

PCT Pub. Date: Nov. 8, 2012

(65) Prior Publication Data

US 2014/0090217 A1 Apr. 3, 2014

Related U.S. Application Data

(60) Provisional application No. 61/482,249, filed on May 4, 2011.

(51) Int. Cl.

| | |
|---|---|
| ***D04H 5/02*** | (2012.01) |
| ***D04H 5/03*** | (2012.01) |
| ***D04H 1/492*** | (2012.01) |
| *D04H 1/498* | (2012.01) |

(52) U.S. Cl.

CPC ..... *D04H 5/03* (2013.01); *D04H 1/492* (2013.01); *D04H 1/498* (2013.01)

USPC ..... 28/104

(58) Field of Classification Search

CPC ..... D04H 5/03; D04H 1/465; D04H 1/492; D04H 1/498; D04H 1/4374

USPC ..... 28/104, 105, 167; 442/384, 385, 387, 442/389, 390, 408; 156/148; 162/115, 204, 162/125, 129, 133; 264/280, 557

See application file for complete search history.

(56) References Cited

U.S. PATENT DOCUMENTS

| | | | |
|---|---|---|---|
| 4,808,467 | A | 2/1989 | Suskind et al. |
| 4,813,864 | A | 3/1989 | Balk |

(Continued)

FOREIGN PATENT DOCUMENTS

| | | | |
|---|---|---|---|
| CA | 841938 | A | 5/1970 |
| EP | 0308320 | A2 | 3/1989 |

(Continued)

OTHER PUBLICATIONS

International Search Report (PCT/ISA/210) mailed on Jul. 26, 2012, by the Swedish Patent Office as the International Searching Authority for International Application No. PCT/SE2012/050461.

(Continued)

*Primary Examiner* — Amy Vanatta
(74) *Attorney, Agent, or Firm* — Buchanan Ingersoll & Rooney PC

(57) ABSTRACT

A method of producing a nonwoven material by hydroentangling a fiber mixture containing spunlaid filaments, natural fibers and synthetic staple fibers, wherein a first fibrous web (12) of natural fibers and at least 10% by fiber weight manmade staple fibers is wetlaid and hydroentangled in a first hydroentangling station (13), spunlaid filaments (16) are laid on top of the hydroentangled first fibrous web (12) and a second fibrous web (19) including natural fibers is wetlaid on top of said spunlaid filaments (16). The second fibrous web (19) is hydroentangled together with the spunlaid filaments (16) in a second hydroentangling station (20) and the combined webs are reversed and the first fibrous web (12) of natural fibers and manmade staple fiber is hydreoentagled together with the spunlaid filaments (16) in a third hydroentangling station (25).

10 Claims, 2 Drawing Sheets

(56) References Cited

U.S. PATENT DOCUMENTS

| | | | | |
|---|---|---|---|---|
| 4,931,355 | A | 6/1990 | Radwanski et al. | |
| 4,939,016 | A | 7/1990 | Radwanski et al. | |
| 4,950,531 | A | 8/1990 | Radwanski et al. | |
| 5,290,628 | A | 3/1994 | Lim et al. | |
| 5,324,580 | A | 6/1994 | Allan et al. | |
| 5,545,371 | A | 8/1996 | Lu | |
| 5,720,851 | A | 2/1998 | Reiner | |
| 6,063,717 | A | 5/2000 | Ishiyama et al. | |
| 6,110,848 | A | 8/2000 | Bouchette | |
| 6,163,943 | A | 12/2000 | Johansson et al. | |
| 7,331,091 | B2 * | 2/2008 | Strandqvist | 28/104 |
| 7,422,660 | B2 * | 9/2008 | Billgren et al. | 162/199 |
| 2002/0157766 | A1 | 10/2002 | Vuillaume et al. | |
| 2003/0106195 | A1 * | 6/2003 | Fleissner | 28/104 |
| 2005/0022954 | A1 * | 2/2005 | Strandqvist | 162/115 |
| 2005/0091811 | A1 * | 5/2005 | Billgren et al. | 28/104 |
| 2010/0075120 | A1 * | 3/2010 | Gustafsson et al. | 428/196 |

FOREIGN PATENT DOCUMENTS

| | | | |
|---|---|---|---|
| EP | 0534863 | A1 | 3/1993 |
| EP | 0333228 | B1 | 2/1994 |
| EP | 0333211 | B1 | 5/1994 |
| EP | 0992338 | A2 | 4/2000 |
| EP | 2116645 | A1 | 11/2009 |
| WO | WO 94/11557 | A1 | 5/1994 |
| WO | WO 96/02702 | A1 | 2/1996 |
| WO | WO 99/22059 | A1 | 5/1999 |
| WO | WO 02/055778 | A1 | 7/2002 |
| WO | WO 03/083197 | A1 | 10/2003 |
| WO | WO 2005/042819 | A2 | 5/2005 |

OTHER PUBLICATIONS

Written Opinion (PCT/ISA/237) mailed on Jul. 26, 2012, by the Swedish Patent Office as the International Searching Authority for International Application No. PCT/SE2012/050461.

International Preliminary Report on Patentability mailed on Jul. 16, 2013 as the International Preliminary Examining Authority for International Application No. PCT/SE2012/050461.

* cited by examiner

METHOD OF PRODUCING A HYDROENTANGLED NONWOVEN MATERIAL

TECHNICAL FIELD

The present invention refers to a method for manufacturing a hydroentangled nonwoven material, said nonwoven material comprising a mixture of natural fibers, manmade staple fibers and spunlaid filaments.

BACKGROUND OF THE INVENTION

Absorbing nonwoven materials are often used for wiping spills and leakages of all kinds in industrial, service, office and home locations. There are great demands on the properties of nonwoven materials made for wiping purposes. An ideal wiper should be strong, absorbent, abrasion resistant and exhibit low linting. It should further be soft and have a textile touch. Hydroentangled nonwoven materials are often used as wipes because of their absorbent and textile-like properties.

Hydroentangling or spunlacing is a technique introduced during the 1970'ies, see eg CA patent no. 841 938. The method involves forming a fibre web which is either drylaid or wetlaid, after which the fibres are entangled by means of very fine water jets under high pressure. Several rows of water jets are directed against the fibre web which is supported by a movable fabric. The entangled fibre web is then dried. The fibres that are used in the material can be synthetic or regenerated staple fibres, eg polyester, polyamide, polypropylene, rayon or the like, pulp fibres or mixtures of pulp fibres and staple fibres. Spunlace materials can be produced in high quality to a reasonable cost and have a high absorption capacity. They can eg be used as wiping material for household or industrial use, as disposable materials in medical care and for hygiene purposes etc.

Through eg EP-B-0 333 211 and EP-B-0 333 228 it is known to hydroentangle a fibre mixture in which one of the fibre components consists of continuous filaments in the form of meltblown fibres. The base material, ie the fibrous material which is exerted to hydroentangling, either consists of at least two combined preformed fibrous layers where at least one of the layers is composed of meltblown fibres, or of a "coform material" where an essentially homogeneous mixture of meltblown fibres and other fibres is airlaid on a forming fabric.

Through EP-A-0 308 320 it is known to bring together a prebonded web of continuous filaments with a separately prebonded wetlaid fibrous web containing pulp fibres and staple fibres and hydroentangle together the separately formed fibrous webs to a laminate. In such a material the fibres of the different fibrous webs will not be integrated with each other since the fibres already prior to the hydroentangling are bonded to each other and only have a very limited mobility. The material will show a marked twosidedness.

WO 99/22059 discloses a method of producing a nonwoven material by hydroentangling a mixture of continuous filaments, natural fibers and/or synthetic staple fibers. A fibrous web of natural fibers and/or synthetic staple fibers is foamformed and hydroentangled and integrated with the continuous filaments, for example meltblown fibers.

WO 2005/042819 discloses a method of producing a nonwoven material by forming a web of continuous filaments on a forming fabric and applying a wet-formed fibre dispersion containing synthetic staple fibres having a length between 3 and 7 mm, and natural fibres on top of said continuous filaments. The fibrous web is subsequently hydroentangled to form a nonwoven material.

One problem is clearly seen in hydroentangled materials—they will very often be markedly twosided, ie it can clearly be discerned a difference between the side facing the fabric and the side facing the water jets in the entangling step. In some cases this has been used as a favourable pattern, but in most cases it is seen as a disadvantage. When two separate layers are combined and fed into an entangling process, normally this process step cannot thoroughly mix the layers, but they will still exist, albeit bonded to each other. With pulp in the composite there will be a pulp-rich side and a pulp-poor side, which will result in differing properties of the two sides. This is pronounced when spunlaid filaments are used as they tend to form a flat two-dimensional layer when created, which will mix poorly.

It is further known to make a material having the same fiber composition on both sides, wherein in a first step a hydroentangled nonwoven material is produced comprising a mixture of pulp fibers and synthetic staple fibers, said mixture being wetlaid on top of a web of spunlaid filaments. In a second step said hydroentangled nonwoven material is fed back into the process and a second mixture of pulp fibers and synthetic staple fibers is wetlaid on top of the hydroentangled nonwoven. The combined fibrous layers are then hydroentangled. This is a costly, time consuming and energy demanding process which does not fully solve the problem.

SUMMARY OF THE INVENTION

The object of the invention is to provide an in-line process for manufacturing a hydroentangled nonwoven material, said nonwoven material comprising a mixture of natural fibers, manmade staple fibers and spunlaid filaments, wherein the nonwoven material has reduced twosidedness, ie both sides should have appearances and properties that are similar. This has been achieved by a process comprising the steps of: wetlaying a first fibrous web of natural fibers and at least 10% by weight of manmade staple fibers, hydroentangling said first fibrous web in a first hydroentangling station, laying spunlaid filaments on top of said hydroentangled first fibrous web, wetlaying a second fibrous web comprising natural fibers on top of said spunlaid filaments and hydroentangling together said second fibrous web with the spunlaid filaments in a second hydroentangling station, thus forming a combined web comprising said first and second fibrous webs and said spunlaid filaments, reversing said combined web and hydroentangling together the first fibrous web of natural fibers and manmade staple fiber with the spunlaid filaments in a third hydroentangling station.

The fluid pressure used in the first hydroentangling station may be between 10 and 50 bars.

The fluid pressure used in the second and third hydroentangling stations may be between 70 and 200 bars.

The first fibrous web of natural fibers and manmade staple fibers may contain between 10 and 40% by fibre weight manmade staple fibers and between 60 and 90% by fiber weight natural fibers.

The second fibrous web of natural fibers and manmade staple fibers may contain between 10 and 40% by fibre weight manmade staple fibers and between 60 and 90% by fiber weight natural fibers.

The natural fibers may be wood pulp fibers.

The manmade staple fibers may have a length between 3 and 25 mm.

There may be no thermal bonding points between the spunlaid filaments.

The first fibrous web of natural fibers and manmade staple fibers may be wetformed by wetlaying an aqueous dispersion of said fibers.

The second fibrous web of natural fibers and optionally manmade staple fibers may be foamformed by wetlaying a foamed dispersion of said fibers.

The hydroentangled wetlaid first fibrous web may be dewatered to a dry content of between 30 and 50 weight % before laying spunlaid filaments on top of said hydroentangled wetlaid first fibrous web.

DEFINITIONS

Spunlaid Filaments

Filaments are fibres that in proportion to their diameter are very long, in principle endless. They can be produced by melting and extruding a thermoplastic polymer through fine nozzles, whereafter the polymer will be cooled, preferably by the action of an air flow blown at and along the polymer streams, and solidified into strands that can be treated by drawing, stretching or crimping. Chemicals for additional functions can be added to the surface. Filaments can also be produced by chemical reaction of a solution of fibre-forming reactants entering a reagence medium, eg by spinning of viscose fibres from a cellulose xanthate solution into sulphuric acid.

Spunlaid filaments are produced by extruding molten thermoplastic polymer through fine nozzles in very fine streams. The filaments are stretched by air to get an appropriate diameter. The fibre diameter is usually above 10 μm, often in the interval 10-100 μm. Production of spunbond is eg described in U.S. Pat. No. 4,813,864 or 5,545,371.

Any thermoplastic polymer, that has enough coherent properties to be drawn out in this way in the molten state, can in principle be used for producing spunlaid filaments. Examples of useful polymers are polyolefins, such as polyethylene and polypropylene, polyamides, polyesters and polylactides. Copolymers of these polymers may of course also be used, as well as natural polymers with thermoplastic properties.

Natural Fibres

There are many types of natural fibres that can be used in hydroentangled nonwoven material, especially those that have a capacity to absorb water and tendency to aid in creating a coherent sheet. Among the natural fibres possible to use there are primarily cellulosic fibres such as seed hair fibres, eg cotton, kapok, and milkweed; leaf fibres eg sisal, abaca, pinapple, and New Zealand hamp; or bast fibres eg flax, hemp, jute, kenaf, and pulp. Wood pulp fibres are especially well suited to use, and both softwood fibres and hardwood fibres are suitable. Recycled fibres can also be used.

The pulp fibre lengths will vary from around 3 mm for softwood fibres and around 1,2 mm for hardwood fibres and a mix of these lengths, and even shorter, for recycled fibres.

Staple Fibres

Manmade staple fibres used can be produced from the same polymeric substances as described for spunlaid filaments above. Other usable manmade staple fibres are those made from regenerated cellulose such as viscose and lyocell. Staple fibers are cut lengths from filaments. They can be treated with spin finish and crimped, but this is not necessary for the type of processes preferably used to produce the material described in the present invention. The cutting of the fibre bundle normally is done so as to result in a single cut length, which is determined by the distance between the knives of the cutting wheel. Depending on the planned use different fibre lengths are used. Wetlaid hydroentangled nonwovens can use lengths between 3 and 25 mm.

BRIEF DESCRIPTION OF THE DRAWINGS

The invention will below be described with reference to an embodiment shown in the accompanying drawing.

DETAILED DESCRIPTION OF AN EMBODIMENT

Figure 1:
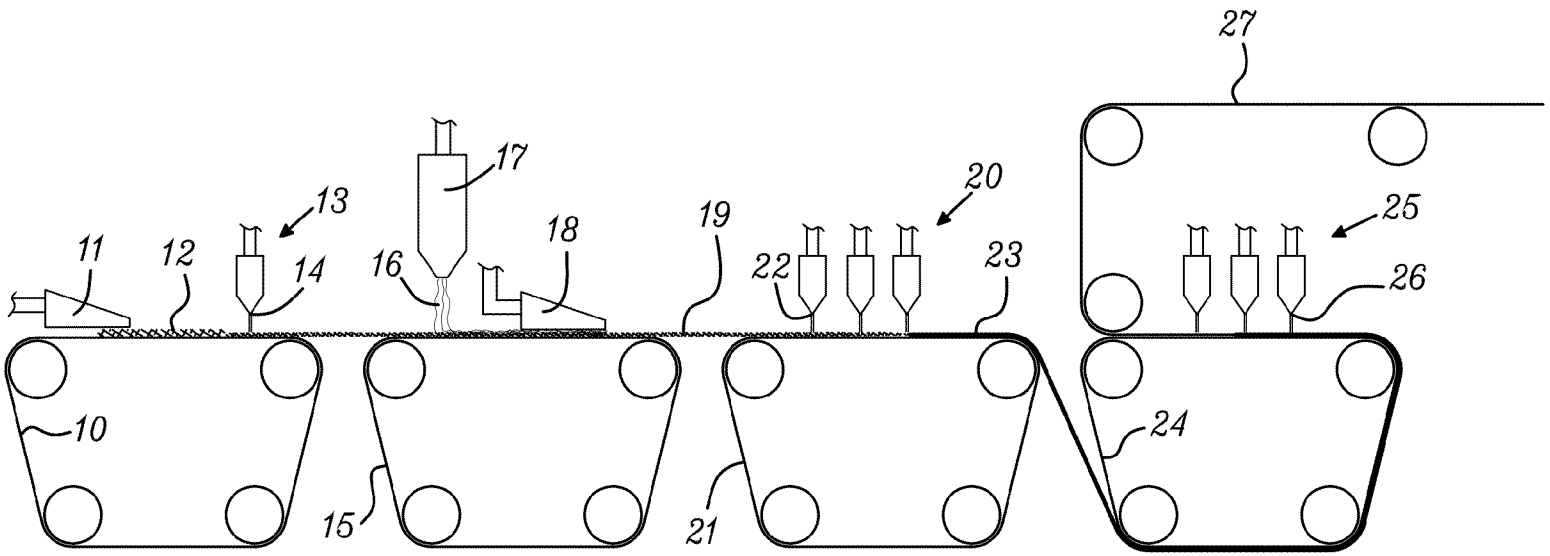
FIG. 1 illustrates schematically a process for manufacturing a hydroentangled nonwoven material according to the invention.

One example of a method according to the invention for producing a hydroentangled nonwoven material is shown in FIG. 1. A slurry comprising a mixture of natural fibers and manmade staple fibers is wetlaid on a forming fabric 10 by a headbox 11. The slurry may besides water contain conventional papermaking additives such as wet and/or dry strength agents, retention aids and dispersing agents. A special variant of wetlaying or wetforming is foamforming, wherein the natural fibers and staple fibers are dispersed in a foamed liquid containing water and a surfactant. The liquid or foam is sucked through the forming fabric 10 by means of suction boxes (not shown) arranged under the forming fabric, so that a first fibrous web 12 comprising natural fibers and manmade staple fibers is formed on the forming fabric 10. Foamforming is described in for example WO 96/02702 A1. An advantage of foamforming is that it requires less liquid to be pumped and sucked through the forming fabric as compared to traditional wetforming without foam.

The proportion of natural fibers and manmade staple fibers used for forming the first fibrous web is between 60 and 90% by weight natural fibers and between 10 and 40% by weight manmade staple fibers. The natural fibers and manmade staple fibers may be of the kind referred to above.

The first fibrous web 12 is hydroentangled in a first hydroentangling station 13 while it is still supported by the forming fabric 10. The first hydroentangling station 13 can include a transverse bar with a row of nozzles 14 from which very fine water jets under pressure are directed against the first fibrous web to provide an entangling of the fibres. Suction boxes (not shown) are arranged under the forming fabric 10 just opposite the nozzles 14. The entangling pressure used in nozzles of the first hydroentangling station may be relatively low, between 10 and 50 bars, to provide only a slight bonding of the first fibrous web 12. The bonding of the first fibrous web 12 may only be sufficient for making the web 12 self-supporting, for example so that it may be transferred from the first forming fabric 10 to a second forming fabric 15. The first forming fabric 10 should have a relatively high count (low open area) in order to retain the fibers in the wetlaid web, while the second forming fabric 15 may have a relatively lower count (relatively higher open area), which will be described below.

The tensile strength in MD (machine direction) of the first fibrous web 12 should be at least 50 N/m in order to be self-supporting, however preferably not more than 100 N/m. Further dewatering of the wetlaid first fibrous web 12 may, if necessary, take place by means of suction boxes (not shown) after transfer to the second forming fabric 16 in order to achieve a suitable dry content of the first fibrous web. Since air is drawn through the web in the subsequent spunlaying step (described below) a suitable dry content of the wetlaid first fibrous web is between 30 and 50 weight %.

Preferably only one row of nozzles 14 is used in the first hydroentangling station. The basis weight of the first fibrous web 12 may be between 10 and 100 g/m$^2$.

Spunlaid filaments 16 of spunbond type are laid on top of the hydroentangled first fibrous web 12. The spunlaid filaments 16 are made from extruded molten thermoplastic pellets and are laid down directly on the first fibrous web 12 from nozzles 17. Air is drawn through the web in the spunlaying station by suction boxes (not shown) arranged under the forming fabric 15. In order to allow air to be drawn through the second forming fabric 15, this should have a relatively low count (relatively high open area). The spunlaid filaments are allowed to form a web, which may be slightly bonded or alternatively unbonded, wherein the spunlaid filaments can move relatively freely from each other. The degree of bonding due to stickiness of the spunlaid filaments is controlled by the distance between the nozzles 17 and the forming fabric 15. If this distance is relatively large, the spunlaid filaments are allowed to cool down before they land on top of the first fibrous web 12, so that their stickiness is largely reduced. Alternatively cooling of the filaments is achieved in some other way, eg by means of using multiple air sources where air is used to cool the filaments when they have been drawn out or stretched to the preferred degree.

Since the spunlaid filaments 16 are laid on top of the moist wetlaid fibrous web 12 the filaments will adhere and stay as they land on the moist web 12, thus keeping the formation which otherwise may be hard to preserve on a forming wire. In order to further improve formation of the spunlaid filaments they may be charged to repel each other, or be laid in sequence by two or more spunlaying stations.

The speed of the spunlaid 16 filaments as they are laid down on the first fibrous web 12 is much higher than the speed of the forming fabric 15, so the spunlaid filaments will form irregular loops and bends as they are collected on the forming fabric on top of the first fibrous web 12 to form a very randomized precursor web. The basis weight of the formed filament precursor web may be between 10 and 50 g/m$^2$.

A slurry comprising natural fibers and optionally manmade staple fibers is wetlaid on top of the web of spunlaid filaments 16 from a headbox 18 to form a second fibrous web 19 of natural fibers and optionally manmade staple fibers. The basis weight of the second fibrous web 19 may be in the same range as the first fibrous web 12. The second fibrous web may also contain manmade staple fibers and the proportion of natural fibers and manmade staple fibers as well as type of fibers may be the same as for the first fibrous web 12. Foamforming may be used for forming the second fibrous web 19 of natural fibers and optionally manmade staple fibers. The liquid or foam is sucked through the forming fabric 15 by means of suction boxes (not shown) arranged under the forming fabric.

According to one embodiment the first fibrous web 12 of natural fibers and manmade staple fibers is formed by wetlaying an aqueous dispersion of said fibers and the second fibrous web 19 of natural fibers and manmade staple fibers is foamformed by wetlaying a foamed dispersion of said fibers.

The second fibrous web 19 of natural fibers and manmade staple fibers is hydroentangled together with the web of continuous filaments 16 in a second hydroentangling station 20 while supported on a hydroentangling fabric 21. In the embodiment shown in FIG. 1 the second hydroentangling station 20 comprises three rows of hydroentangling nozzles 22. Any appropriate number of rows of nozzles 22 may be used. The entangling pressure used in the nozzles 22 of the second hydroentangling station 20 is higher than in the first hydroentangling station 13 and is preferably in the range between 70 and 200 bars. The hydroentangling water is drained off through the fabric 21 by means of suction boxes (not shown). An intense mixing of the staple fibres and pulp fibres (or other natural fibers) in the second fibrous web 19 and the continuous filaments 16 is achieved in the second hydroentangling station 20. By having the continuous filaments 16 unbonded with no thermal bonding points between them or only slightly bonded, the continuous filaments can twist around and entangle with themselves and with the staple fibers and pulp fibers, which gives a good integration between the different types of fibers and filaments. The first fibrous web 12 of manmade staple fibers and natural fibers is more or less unaffected by the water jets from the first hydroentangling station 20. However the pressure from the water jets will press the first fibrous web 12 closer against the hydroentangling fabric 21 to conform to the structure of the fabric 21.

The thus formed web 23, which has been hydroentangled from one side, is transferred to another hydroentangling fabric 24, wherein it is traversed at the transfer so that the first fibrous web 12 will be on the top side and the second fibrous web 19 will be facing the hydroentangling fabric 24. A third hydroentangling station 25 comprising three rows of hydroentangling nozzles 26 is arranged to hydroentangle together the first fibrous web 12 of natural fibers and manmade staple fibers with the web of continuous filaments 16. Any appropriate number of rows of nozzles 26 may be used. The entangling pressure used in the nozzles 26 of the third hydroentangling station 25 may be in the same range as in the second hydroentangling station 13, i.e. preferably in the range between 70 and 200 bars. The hydroentangling water is drained off through the fabric 24 by means of suction boxes (not shown). An intense mixing and integration of the staple fibres and pulp fibres (or other natural fibers) in the first fibrous web 12 and the continuous filaments 16 is achieved in the third hydroentangling station 25 to produce a fibrous web 27 that has been hydroentangled from both sides. The pressure from the water jets will further press to second fibrous web 19 closer against the hydroentangling fabric 24 to conform to the structure of the fabric 24. If the patterns in the hydroentangling fabrics 21 and 24 are the same or at least similar the opposite surfaces of the web 27 will have a similar structure.

The water jet pressure in the hydroentangling stations having two or more rows of nozzles may be adapted to have a certain pressure profile with different pressures in the different rows of nozzles.

The three forming and hydroentangling fabrics 10, 15 and 21 may in an alternative embodiment be replaced by a single forming and hydroentangling fabric. In a further alternative embodiment two forming and hydreoentangling fabrics are used instead of the three fabrics 10, 15 and 21 shown in FIG. 1.

The hydroentangled web 27 is then dried, which can be done on a conventional web drying equipment, preferably of the type used for tissue drying, such as a through-air drying or a Yankee drying equipment. The material is after drying normally wound to form mother rolls before converting. The material is then converted in known ways to suitable formats and packed.

The structure of the material can be changed by further processing such as microcreping, hot calandering, embossing, etc. Different additives such as wet strength agents, binder chemicals, latexes, debonders, etc. may further be added to the web 27 before or after drying.

Figure 2:
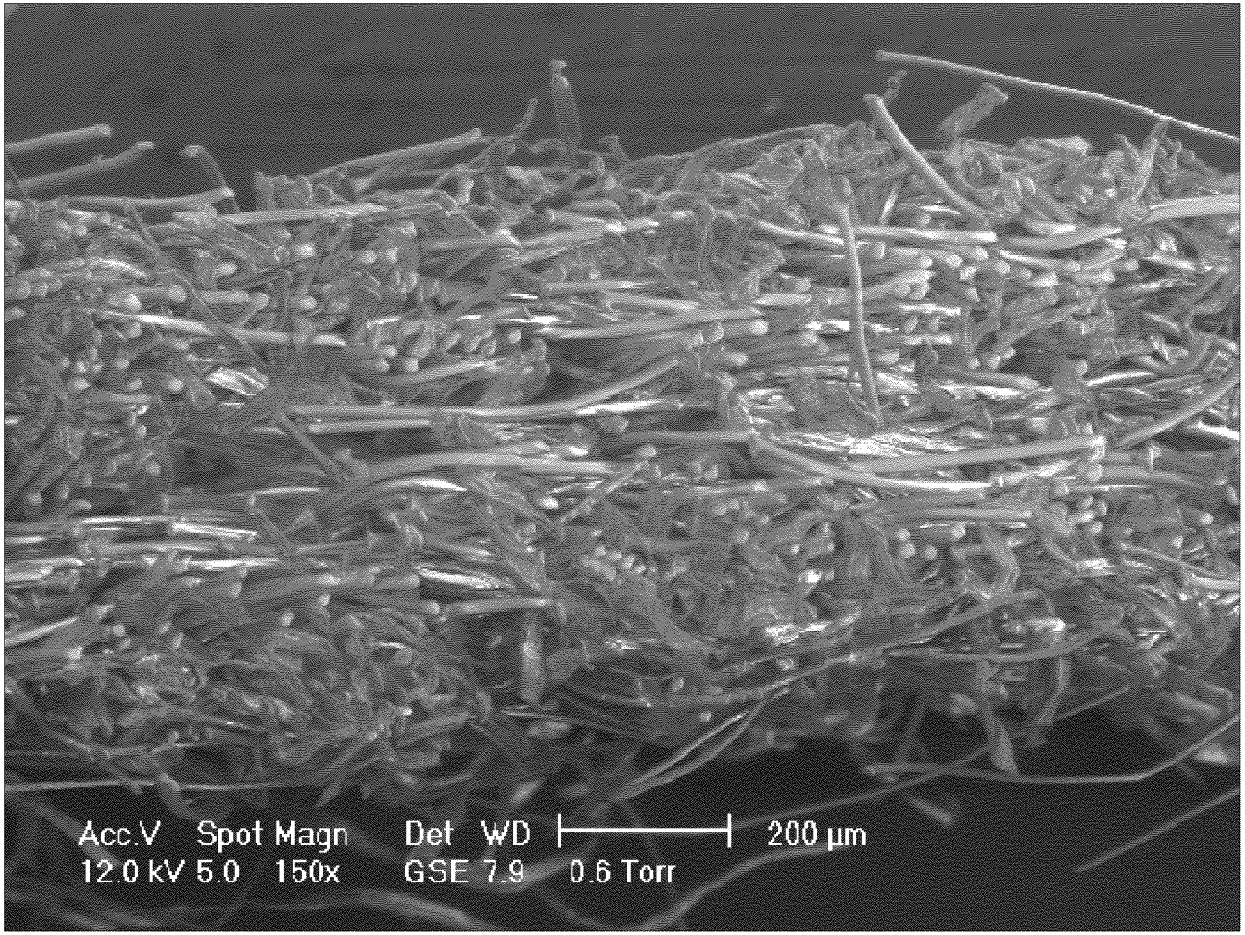
FIG. 2 is a picture taken by scanning electron microscope (SEM) of a cross-section through a nonwoven material produced according to the method.

The hydroentangled nonwoven material produced according to the method described above has an appearance and properties that are very similar on both sides of the material. Thus it has a reduced twosidedness as compared to conventional hydroentangled nonwoven materials. The two outer fibrous webs 12 and 19 are well integrated with the inner layer of spunbond filaments 16. This is illustrated by FIG. 2 which is a microscope picture at magnification of 150 times of a cross-section through a hydroentangled nonwoven material produced by the method according to the invention.

A further important advantage of the method described is that it is an in-line process in which all layers of the nonwoven material are formed in-line. This is more economical than a two step process in which one or more of the layers are pre-formed.

The invention claimed is:

1. A method of producing a nonwoven material by hydroentangling a fiber mixture containing spunlaid filaments, wood pulp fibers and synthetic staple fibers, the method comprising:

wetlaying a first fibrous web of wood pulp fibers and at least 10% by fiber weight of manmade staple fibers, hydroentangling said first fibrous web in a first hydroentangling station, laying spunlaid filaments on top of said hydroentangled first fibrous web, wetlaying a second fibrous web comprising wood pulp fibers on top of said spunlaid filaments and hydroentangling together said second fibrous web with the spunlaid filaments in a second hydroentangling station, thus forming a combined web comprising said first and second fibrous webs and said spunlaid filaments, and reversing said combined web and hydroentangling together the first fibrous web of wood pulp fibers and manmade staple fiber with the spunlaid filaments in a third hydroentangling station.

2. The method as claimed in claim 1, wherein the fluid pressure used in the first hydroentangling station is between 10 and 50 bars.

3. The method as claimed in claim 1, wherein the fluid pressure used in the second and third hydroentangling stations is between 70 and 200 bars.

4. The method as claimed in, claim 1, wherein said first fibrous web of wood pulp fibers and manmade staple fibers contain between 10 and 40% by fibre weight staple fibers and between 60 and 90% by fiber weight wood pulp fibers.

5. The method as claimed in claim 1, wherein said second fibrous web comprises between 10 and 40% by fibre weight staple fibers and between 60 and 90% by fiber weight wood pulp fibers.

6. The method as claimed in claim 1, wherein the manmade staple fibers have a length between 3 and 25 mm.

7. The method as claimed in claim 1, wherein there are no thermal bonding points between the spunlaid filaments.

8. The method as claimed in claim 1, wherein the second fibrous web comprising wood pulp fibers and optionally manmade staple fibers is foamformed by wetlaying of a foamed dispersion of said fibers.

9. The method as claimed in claim 1, wherein the first fibrous web of wood pulp fibers and manmade staple fibers is wetformed by wetlaying an aqueous dispersion of said fibers.

10. The method as claimed in claim 1, further comprising dewatering the hydroentangled wetlaid first fibrous web to a dry content of between 30 and 50 weight % before laying spunlaid filaments on top of said hydroentangled wetlaid first fibrous web.

* * * * *